US005428496A

United States Patent [19]

Buchta

[11] Patent Number: 5,428,496

[45] Date of Patent: Jun. 27, 1995

[54] ELECTRONIC SWITCHING ARRANGEMENT

[75] Inventor: Heinz-Dieter Buchta, Fellbach, Germany

[73] Assignee: Herion-Werke KG, Germany

[21] Appl. No.: 126,922

[22] Filed: Sep. 27, 1993

[30] Foreign Application Priority Data

Sep. 28, 1992 [DE] Germany ..... 42 32 454.8

[51] Int. Cl.[6] ..... H01F 7/18; H01H 47/04

[52] U.S. Cl. ..... 361/152; 361/154; 361/170; 361/187

[58] Field of Search ..... 361/152, 153, 154, 155, 361/156, 170, 187, 189, 190, 194, 196; 340/644

[56] References Cited

U.S. PATENT DOCUMENTS 4,053,876 10/1977 Taylor ..... 361/185 X
4,479,117 10/1984 Marquardt ..... 340/644
4,631,629 12/1986 Mallick, Jr. ..... 361/154
4,777,556 10/1988 Imran ..... 361/156 X
4,797,779 1/1989 Richards et al. ..... 361/154
4,970,622 11/1990 Büchl ..... 361/154
5,196,730 3/1993 Matsuo ..... 361/153
5,196,983 3/1993 Stumpf ..... 361/154
5,241,218 8/1993 Page ..... 361/154 X

*Primary Examiner*—A. D. Pellinen
*Assistant Examiner*—Fritz M. Fleming
*Attorney, Agent, or Firm*—Henry M. Feiereisen

[57] ABSTRACT

An electronic switching arrangement for controlling a coil includes a capacitor for energizing the coil by momentarily passing a current therethrough so as to generate a required attractive force for movement of the armature. After movement of the armature, only a lower holding current is supplied. Arranged parallel to the coil is a voltage divider which cooperates with a transistor to detect and evaluate an unintentional movement of the armature.

9 Claims, 1 Drawing Sheet

ELECTRONIC SWITCHING ARRANGEMENT

BACKGROUND OF THE INVENTION

The present invention refers to an electronic switching arrangement, especially for controlling a coil of an electromagnet for moving an armature. In particular, the present invention relates to an electronic switching arrangement of the type having a voltage supply source charging a capacitor for activating a power transistor after comparison of the charging voltage with a reference voltage for closing the circuit through the coil.

It is generally known that a solenoid or electromagnet requires much more power for drawing the armature than for maintaining the attractive position. Proposals were made to generate a momentary current flow by a capacitor which is charged to a charging voltage in order to provide the electromagnet with the required attractive force for drawing the armature. After generating the attractive force, the coil is supplied only with a lower holding current.

SUMMARY OF THE INVENTION

It is an object of the present invention to provide an improved switching arrangement of the above mentioned type by which the power consumption of the electromagnet is reduced and unintentional armature movements are detected and evaluated.

This object, and others which will become apparent hereinafter, is attained in accordance with the present invention by incorporating a switching circuit parallel to the coil by which an unintentional movement of the armature is detected and suitable countermeasures are initiated.

Preferably, the switching circuit includes a voltage divider in form of two resistors arranged parallel to the coil. The medium voltage of the voltage divider is connected to the base of a transistor, the emitter of which is connected to the positive supply of a power source and the collector of which is connected to the negative supply thereof.

Through incorporation of a further transistor and voltage divider parallel to the coil, the position of the armature can be maintained, i.e. in the drawing mode, and possible undesired movements thereof can be detected and suitably corrected.

Preferably, a resistor is connected between the negative supply, on the one hand, and the collector of the transistor as well as the gate of the power transistor, on the other hand.

Preferably, the switching arrangement further includes a voltage divider in form of two resistors in parallel relationship to the capacitor. The medium voltage of this voltage divider is applied across one input of an operational amplifier, with the other input thereof being connected to a reference voltage source in form of a zener diode. The output of the operational amplifier is connected via a diode to the gate of the power transistor.

BRIEF DESCRIPTION OF THE DRAWING

The above and other objects, features and advantages of the present invention will now be described in more detail with reference to the accompanying drawing in which the sole

DETAILED DESCRIPTION OF PREFERRED EMBODIMENTS

Figure 1:
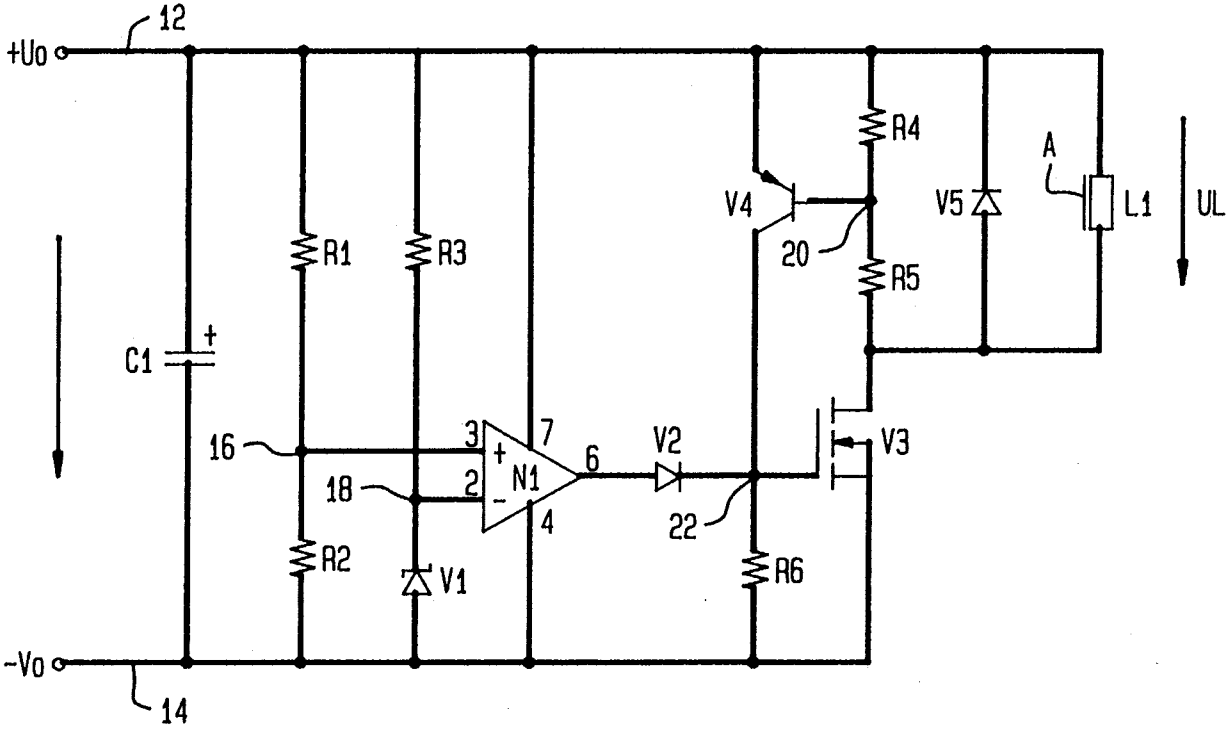
FIG. 1 is a schematic circuit block diagram of a switching arrangement in accordance with the present invention.

Referring now to FIG. 1, there is shown a schematic circuit block diagram of an electronic switching arrangement or circuitry according to the invention, including a coil L1 which is part of a solenoid or electromagnet and is energizable to move or draw an armature (A) for actuating a suitable element (not shown). The coil L1 is connected via lines 12, 14 to a power supply, such as a DC source, to supply a voltage $U_o$, with line 12 leading to the positive supply $+U_o$ and line 14 leading to the negative supply or ground $-U_o$ and being connected to the source of a power transistor (MOS transistor or MOSFET) V3.

Arranged between the lines 12 and 14 is a capacitor C1 and a voltage divider in form of two resistors R1 and R2 which are connected in series and arranged parallel to the capacitor C1. In parallel relationship to the voltage divider R1, R2 between the lines 12, 14 is a reference voltage source in form of a zener diode V1 which provides a reference voltage, and a resistor R3 which is in series with the zener diode V1 and serves for current limitation and thus for a temperature-independent voltage stabilization of the zener diode V1.

Further connected to the lines 12, 14 is an operational amplifier N1 which has one input connected to a point 16 between both resistors R1 and R2 and another input connected to a point 18 between the resistor R3 and the zener diode V1. The output of the operational amplifier N1 is connected to the gate of the power transistor V3 via a diode V2.

Further incorporated in parallel relationship to the coil L1 is a switching circuit which includes a voltage divider in form of resistors R4, R5 arranged in series and a transistor V4, the base of which is connected to the voltage divider at point 20 between both resistors R4, R5. The emitter of the transistor is connected via the line 12 to the positive supply $+U_o$ and the collector is connected via a resistor R6 to the line 14 and thus to the negative supply $-U_o$. The line leading from the diode V2 to the gate of the power transistor V3 is linked at point 22 with the line leading from the transistor V4 to the resistor R6 so that the gate of the power transistor V3 is connected to the negative supply $-U_o$ via the resistor R6.

A protective or clamping diode V5 is further provided parallel to the coil L1 in order to avoid voltage peaks during switch off and thus to prevent destruction of the power transistor.

After having described the individual parts of the electronic switching arrangement according to the invention, its mode of operation is now set forth.

Through application of the operating voltage $U_o$ from the power source across the capacitor C1, the capacitor C1 is charged. When the capacitor C1 reaches its charging voltage, i.e. when the voltage at point 16 exceeds the reference voltage at point 18 as applied by the zener diode V1, the operational amplifier N1 is actuated to activate the power transistor V3.

The resistor R3 merely serves for current limitation and thus for a temperature-independent voltage stabilization of the reference zener diode V1.

The power transistor V3 thus closes the circuit through the coil L1. The stored charge of the capacitor C1 is sufficient to allow flow of necessary current through the coil L1 for a limited period in order to provide the attractive force for the armature A. The activation of the power transistor V3 and the inclusion of the coil L1 in the circuit results in the voltage $U_o$ dropping to the coil voltage UL across the coil L1 and in a voltage drop across the power transistor V3.

The operational amplifier N1 would now block the power transistor V3 since the medium voltage of the voltage divider R1, R2 would become smaller than the voltage of the zener diode V1.

However, the voltage divider R4, R5 now activates the transistor V4, with the collector of the transistor V4 being connected via point 22 with the gate of the power transistor V3 to ensure activation of the power transistor V3 after drop of the voltage across the power transistor V3 whereby the diode V2 prevents the operational amplifier N1 from controlling the power transistor V3. In this manner, the attractive position of the armature A of the solenoid is maintained.

The voltage divider R4, R5 serves however also another purpose. If, for some reason, the armature A of the solenoid is unintentionally moved during operation, e.g. through shaking or vibrations, the movement induces a current in the coil L1. As a result of this induced current, a voltage fluctuation is encountered across the voltage divider R4, R5. When the voltage drop across the resistor R4 becomes smaller than the base-emitter-voltage of the transistor V4, then the transistor V4 is OFF, with the power transistor V3 now being connected to the negative supply $-U_o$ only via the resistor R6 and thus is OFF as well. The switch-off of the power transistor V3 enables the capacitor C1 to recharge.

In this manner, the switching circuit is able to recognize a movement of the armature, e.g. caused through external influence, with voltage peaks which are generated by self-induction being utilized to detect whether or not the armature is still in its attractive position.

As a result of the evaluation of the armature movement, a new charging step is initiated which causes the dropped armature of the solenoid to be automatically drawn again.

Thus, the switching arrangement according to the invention is capable of recognizing and automatically evaluating an unintentional movement of the armature.

Moreover, the voltage divider R4, R5 is capable of monitoring a minimum current with regard to the coil L1. If the current in the coil L1 drops below a predetermined value, the voltage divider R4, R5 responds to the voltage drop across the coil L1 in a same manner as described above in order to automatically draw again the armature A.

While the invention has been illustrated and described as embodied in an electronic switching arrangement, it is not intended to be limited to the details shown since various modifications and structural changes may be made without departing in any way from the spirit of the present invention.

What is claimed as new and desired to be protected by Letters Patent is set forth in the appended claims.

I claim:

1. An electronic switching arrangement for connection to an electromagnet having a coil and an armature; comprising:

a power source with a positive supply and a negative supply for supplying operating voltage;

a capacitor charged by said power source to generate a charging voltage;

a power transistor activated by said capacitor after a comparison of the charging voltage with a reference voltage to pass current through the coil; and switching circuit means provided parallel to the coil for detecting an unintentional movement of the armature, said switching circuit means including a first voltage divider in form of two resistors, connected parallel to the coil, and a transistor having a base, an emitter and a collector, said voltage divider having a medium voltage applied to the base of said transistor, the emitter of which is connected to the positive supply and the collector of which is connected to the negative supply.

2. A switching arrangement as defined in claim 1 wherein said switching circuit means further includes a resistor arranged between the negative supply of said power source, on the one hand, and the collector of said transistor and the gate of said power transistor, on the other hand.

3. A switching arrangement as defined in claim 1, and further comprising a voltage divider in form of two resistors arranged parallel to said capacitor, and an operational amplifier have two inputs and an output, said voltage divider having a medium voltage applied across one of the inputs of said operational amplifier, with the reference voltage being applied across the other input.

4. A switching arrangement as defined in claim 3, and further comprising a diode, said output of said operational amplifier being connected to the gate of said power transistor via said diode.

5. An electronic circuit for connection to an electromagnet of the type having a coil and an armature, comprising:

first means for energizing said coil by passing a current therethrough to thereby draw the armature to an attractive position; said first means including a power source having a positive supply and a negative supply for supplying operating voltage, a capacitor charged by said power source to generate a charging voltage, a reference voltage source for providing a reference voltage, and a power transistor for passing current through said coil, said power transistor being activated by said capacitor after the voltage across said capacitor exceeds the reference voltage; and second means in parallel relationship to said coil for maintaining the attractive position of the armature and counteracting changes in the impedance of said coil caused by motion of said armature to return the armature to its attractive position, said second means including a voltage divider in form of two resistors and a transistor connected parallel to said coil and having a base, an emitter and a collector, said voltage divider having a medium voltage applied to the base of said transistor, the emitter of which is connected to the positive supply and the collector of which is connected to the negative supply.

6. A circuit as defined in claim 5 wherein said power transistor is a MOS transistor having a gate, said second means further including a resistor arranged between the negative supply of said power source, on the one hand, and the collector of said transistor and the gate of the power transistor, on the other hand.

7. A circuit as defined in claim 5 wherein said first means includes a voltage divider in form of two resistors arranged parallel to said capacitor, and an operational amplifier have two inputs and an output, said voltage divider applying a voltage across one of the inputs of said operational amplifier, with the reference voltage being applied across the other input.

8. A circuit as defined in claim 7 wherein said first means includes a diode connected between the output of said operational amplifier and the gate of said power transistor.

9. A circuit as defined in claim 5 wherein said reference voltage source is a zener diode.

* * * * *